US006942046B2

(12) United States Patent
Binon et al.

(10) Patent No.: US 6,942,046 B2
(45) Date of Patent: Sep. 13, 2005

(54) BORE BIT FOR VERY HARD MATERIAL

(75) Inventors: Stéphane Binon, Nanterre (FR); Benoit Quandalle, Nanterre (FR); Olivier Vacher, Nanterre (FR); Germain Viroles, Nanterre (FR)

(73) Assignee: Compagnie du Sol, Nanterre (FR)

( * ) Notice: Subject to any disclaimer, the term of this patent is extended or adjusted under 35 U.S.C. 154(b) by 48 days.

(21) Appl. No.: 10/271,907

(22) Filed: Oct. 15, 2002

(65) Prior Publication Data

US 2003/0230434 A1 Dec. 18, 2003

(Under 37 CFR 1.47)

(51) Int. Cl.[7] ..... E21B 10/36
(52) U.S. Cl. ..... 175/415; 175/305
(58) Field of Search ..... 175/293, 298, 175/305, 327, 332, 405

(56) References Cited

U.S. PATENT DOCUMENTS

| | | | | |
|---|---|---|---|---|
| 2,371,498 A | | 3/1945 | Boynton | |
| 2,566,913 A | | 9/1951 | Watson | |
| 3,788,409 A | * | 1/1974 | Curington | 175/426 |
| 3,837,414 A | | 9/1974 | Swindle | |
| 4,187,919 A | * | 2/1980 | Lambot | 175/246 |
| 4,705,118 A | | 11/1987 | Ennis | |
| 4,919,221 A | | 4/1990 | Pascale | |
| 4,962,822 A | * | 10/1990 | Pascale | 175/258 |
| 6,315,063 B1 | * | 11/2001 | Martini | 175/57 |

FOREIGN PATENT DOCUMENTS

| | | |
|---|---|---|
| DE | 1 813 400 | 12/1968 |

* cited by examiner

*Primary Examiner*—Zakiya Walker
(74) *Attorney, Agent, or Firm*—Merchant & Gould P.C.

(57) ABSTRACT

An apparatus including a bore bit comprising a bottom part having an active bottom face and a top face substantially parallel to the active face; a top part fixed to suspension cables and having a bottom face facing the top face of the bottom part; a member for limiting the maximum spacing between the two parts; a cylindrical axial bore passing through both parts; a cylindrical guide penetrating into said bore; and at least one ramp-forming recess and at least one ramp-forming extension for co-operating with said ramp-forming recess in such a manner that movement of the top part towards the bottom part is converted into rotary movement of said top part about the vertical axis, with the end of said rotary movement of the top part imparting rotary movement to the bottom part.

9 Claims, 2 Drawing Sheets

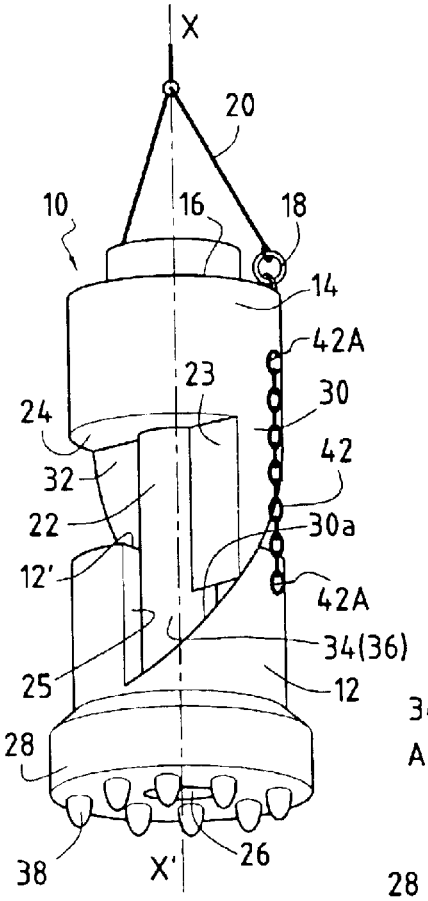
FIG.1A
FIG.1B
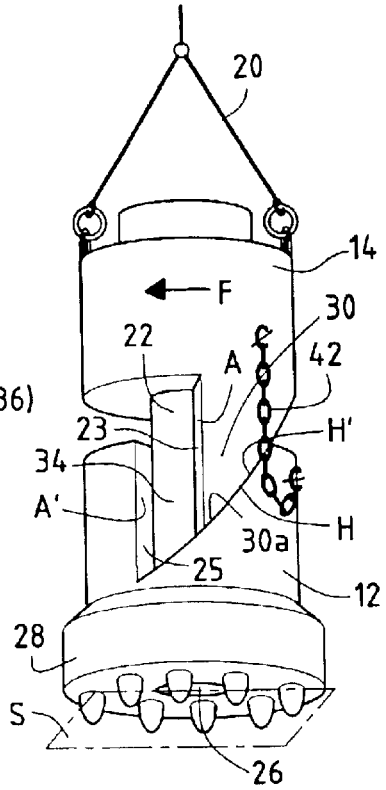
FIG.1C
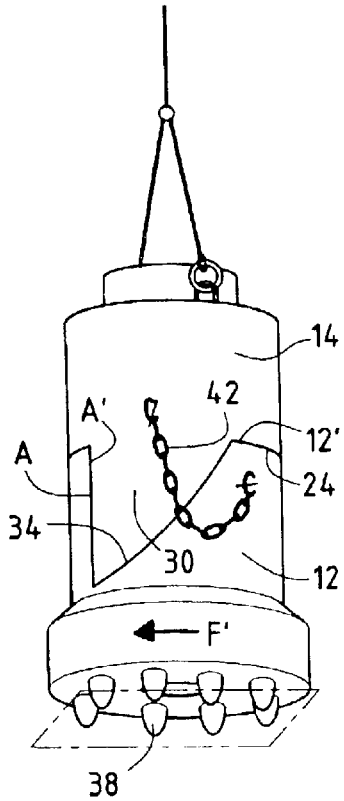
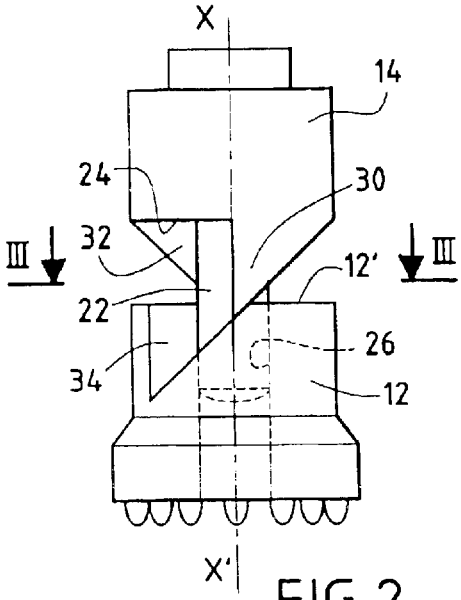
FIG.2
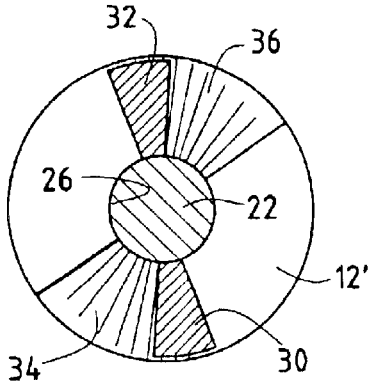
FIG.3

BORE BIT FOR VERY HARD MATERIAL

The present invention relates to a bore bit specially adapted to drilling or to making anchoring holes in granite or other very hard material.

BACKGROUND OF THE INVENTION

Improving excavation rates in very hard ground comes up against severe limits imposed by traditional boring techniques. Progress in boring has, until now, been slowed down by the following inadequacy:

the materials for building up by welding or the steel bars for connection by welding as used in bore bits are generally softer or less abrasive than the granite or other similar materials they are to destroy.

OBJECTS AND SUMMARY OF THE INVENTION

There therefore exists a real need for bore bits that are capable of working in hard ground in order significantly to increase the efficiency of boring operations performed in hard ground, and in particular in granite.

An object of the present invention is thus to provide a novel bore bit that makes it possible to improve the efficiency of said operation without suffering from the difficulties associated with building up the active elements of the bit.

To achieve this object, the bore bit of the invention comprises:

a bottom part having an active bottom face and a top face that is substantially parallel to the active face;

a top part having a top face provided with members for fastening to support cables and a bottom face facing the top face of the bottom part; and means for limiting the extent to which the two parts can move apart, while allowing them to move towards each other;

said bore bit further comprising:

a cylindrical axial bore passing through said two parts;

a cylindrical guide penetrating freely in said axial bore; and at least one ramp-forming recess opening out into one of the facing faces and at least one ramp-forming extension projecting from the other of the facing faces to co-operate with said ramp-forming recess in such a manner that movement of the top part towards the bottom part is converted into rotary movement of said top part about the common axis of the axial bore and the cylindrical guide, with the stopping of rotation of the top part imparting rotary movement to the bottom part.

It will be understood that because the bore bit is made up of two distinct parts capable of moving in vertical translation relative to each other, the bottom part of the bit strikes the ground initially at the location where drilling is to be performed, after which the top part comes closer to the bottom part while being guided in translation by the co-operation between the recess, the axial hole, and the cylindrical axial guide. In addition, the co-operation between the recess in the form of a ramp and the extension in the form of a ramp serves to convert the vertical translation movement of the top part into rotary movement of said top part about the common axis of the axial bore and of the cylindrical axial guide.

At the end of its drop, the top part strikes the bottom part in rotary manner, thereby transferring rotary motion to the active face in addition to the vertical impact.

In a preferred embodiment, in the bit, the bottom and top parts are cylindrical, having axes corresponding respectively to the axis of the cylindrical guide and to the axis of the axial bore, and:

said ramp-forming extension is defined by a portion of a cylindrical helix and by a portion of a plane containing the axis of said axial bore; and said ramp-forming recess is defined by a portion of a helix identical to the helix of the ramp-forming extension, and by a portion of a vertical plane containing the axis of said axial bore, co-operation between the vertical planes imparting rotary movement to the bottom part at the end of the rotary movement of the top part.

It will be understood that the ramp-shaped male and female elements have a helical shape that matches the cylindrical shape of the top and bottom parts of the bit, and as a result as they move together under good conditions, with the motion in translation of the top part of the bit being converted into rotary movement of said top part of the bit. At the end of this rotation, the vertical planes of the ramps strike one another, thereby imparting a rotary movement to the bottom part.

BRIEF DESCRIPTION OF THE DRAWINGS

Other characteristics and advantages of the invention appear better on reading the following description of a preferred embodiment of the invention, given as a non-limiting example.

The description refers to the accompanying figures, in which:

FIGS. 1A to 1C show the bore bit in three different stages during its drilling action;

FIG. 2 is an elevation view of the bit in its relative position corresponding to FIG. 1A;

FIG. 3 is a horizontal section view on line III—III of FIG. 2; and

MORE DETAILED DESCRIPTION

Figure 4A:
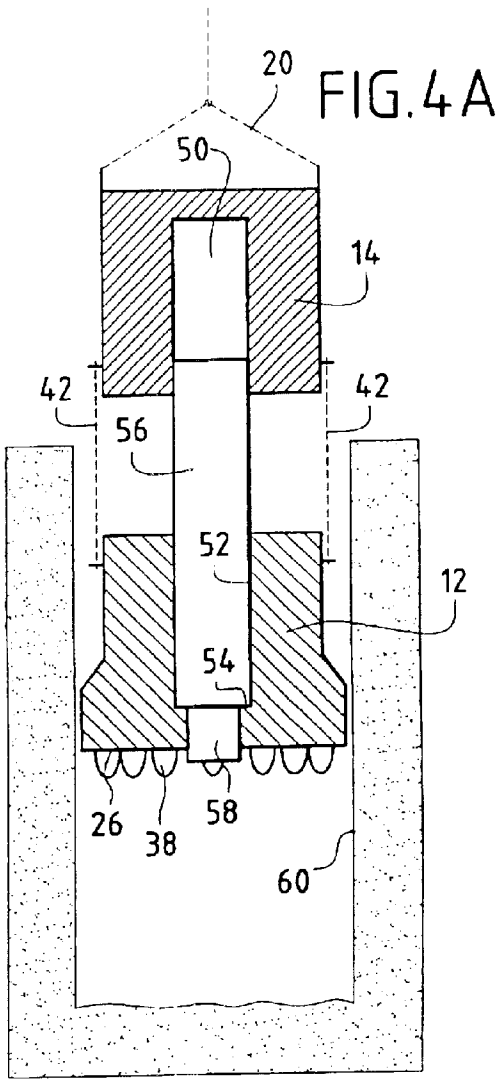
FIGS. 4A to 4C show different steps in the use of a second embodiment of the bore bit.

As mentioned above, according to an essential characteristic of the invention, the bore bit 10 as a whole is made up of a bottom part 12 and a top part 14. The top part 14 has lugs or the like 18 for fixing to the end of a cable or sling 20 from which the bit is suspended. The top part 14 is guided in vertical translation relative to the bottom part 12 by cooperation between a cylindrical guide 22 projecting from the bottom face 24 of the top part 14 and a cylindrical axial bore 26 formed in the bottom part 12 of the bit and opening out into the top face 12' of the bottom part 12. The facing faces 24 and 12' are parallel to each other and substantially horizontal. The cylindrical guide 22 and the cylindrical bore 26 define a common vertical axis X-X' along which the top part 14 can move relative to the bottom part 12.

Naturally, it would not go beyond the ambit of the invention for the axial cylindrical extension to be integral with the bottom part 12 and for the cylindrical axial bore to be made in the top part 14.

As explained below, a third embodiment of the bit is also possible.

The top part 14 is preferably cylindrical about the axis X-X' and also preferably includes two extensions 30 and 32 which are diametrically opposite about the axis X-X' and which project from the bottom face 12 of the top part 14.

These extensions are defined firstly by a plane A containing the axis X-X' and secondly by respective helical portions H. The helically-shaped edges H of the extensions 30 and 32 thus constitute a ramp suitable for co-operating with a complementary ramp formed in the bottom part 12 of the bit. The complementary ramp is constituted by diametrically opposite recesses 34 and 36. The recesses are defined firstly by a plane A' containing the axis X-X', and secondly by respective helical portions H' having the same pitch as the helical portions H of the top part. It will be understood that when the top part 14 moves in translation relative to the bottom part 12 along the axial direction X-X', the extensions 30 and 32 of the top part can penetrate progressively into the recesses 34 and 36 of the bottom part. In addition, the planes A and A' define vertical surfaces 23 and 25 respectively for the extensions and for the recesses, which surfaces lie in planes containing the axis X-X'. Under the effect of the mass of the top part which is travelling in vertical translation, the helixes H and H' co-operate to impart rotary movement to the top part 14 of the bit in the direction of arrow F. When turning of the top part is stopped, it imparts rotary movement to the bottom part 12 as explained in greater detail below.

Also preferably, the bottom end 28 of the bottom part 12 is fitted with picks or analogous tools 38 which are made more active and more effective because of the rotary movement imparted to the bottom part 12.

Naturally, the top part 14 of the bit could be fitted with ramp-forming recesses 34 and 36 while the bottom part is fitted with ramp-forming extensions 30 and 32. The end result would naturally be identical.

As shown in FIGS. 1A to 1C, the bottom and top parts 12 and 14 are held together in translation by two chains such as 42 whose ends 42A and 42B are secured respectively to the top and bottom parts 14 and 12 of the bit. So long as the bottom part is not touching the ground, the chains 42 are tensioned, and while in this position, the bottom ends 30*a*, 32*a* of the extensions 30 and 32 are engaged to a small extent in the recesses 34 and 36 in such a manner that the end of the helically-shaped ramp H comes into contact with the end of the ramp H', thus pre-positioning the two parts of the bit so as to enable the helical ramps to co-operate and thus ultimately enable the bottom part of the bit to have rotary movement imparted thereto.

In FIG. 1A, the two parts of the bit are shown in the relative position that they occupy when the bottom part has not yet touched the ground that is to be drilled. FIG. 1B shows the bit in an intermediate position in which the bottom part 12 has struck the ground S and the top part has begun to come closer to the bottom part, with co-operation between the helically-shaped ramps H and H' starting to cause the top part 14 to rotate in the direction of arrow F.

Finally, FIG. 1C shows the end position of the bit with the bottom face 24 of the top part 14 in contact with the top face 12' of the bottom part 12, and with the extensions 30 and 32 completely occupying the recesses 34 and 36. Rotation of the top part 14 is thus completely terminated. The vertical faces 23 of the extensions 30 and 32 come into contact with the vertical faces 25 of the recesses 34 and 36, and as a result the top part 14 of the bit transmits a very large amount of torque to the bottom part 12 causing it to turn in the direction indicated by arrow F', thereby improving the efficiency of the bit.

Naturally, means other than chains 42 could be provided for limiting the maximum spacing between the top and bottom parts 14 and 12.

It will also be understood that the pitch of the helical portions H and H' is determined as a compromise between the desired angle of rotation and suitability for efficiently converting the movement in translation of the top part 14 into rotary movement of the bottom part 12. More precisely, it will be understood that if the pitch is too small, i.e. if the angle made by the tangent to the helix with the axis X-X' is too close to 90°, then this conversion of movement will not take place under favorable conditions.

Figure 4B:
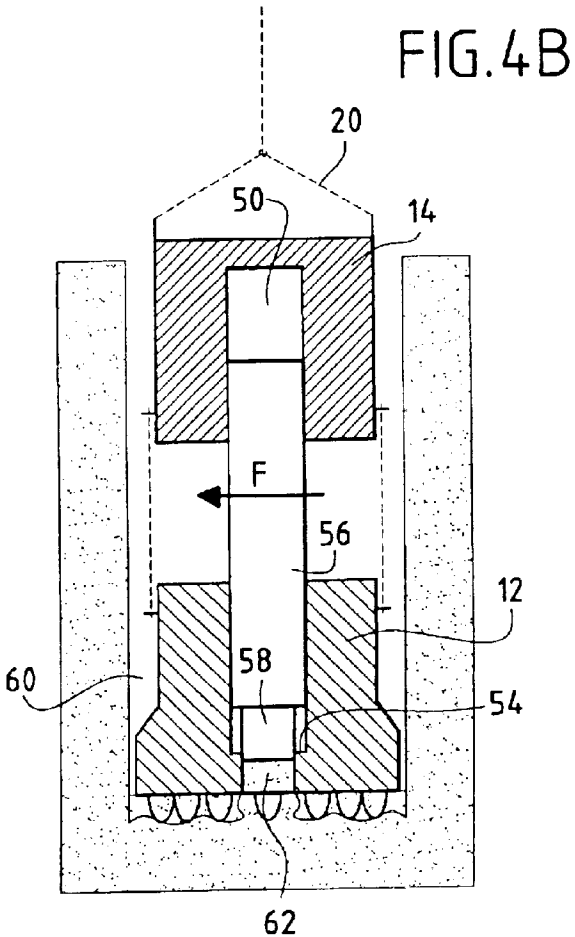
Figure 4C:
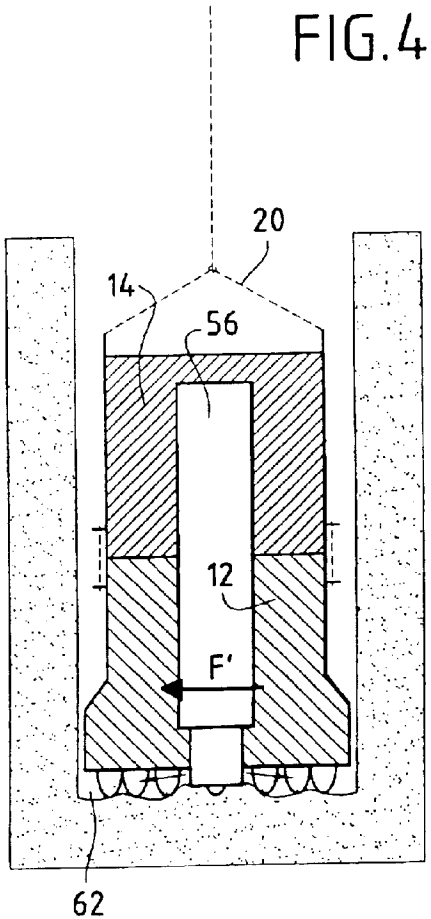

FIGS. 4A to 4C show another embodiment of the bore bit. In this embodiment, the cylindrical guide for providing guidance in translation and the pivot axis is constituted by a part that is distinct from the top and bottom parts of the bit.

The top part 14 has a blind axial bore 50 and the bottom part 12 also has an axial bore 52, this bore opening out into the bottom face 26. The bore 52 has a shoulder 54 close to its bottom end. The cylindrical extension is constituted by a sharp element 56 mounted free to move in translation and in rotation in the axial bores 50 and 52. The bottom end 58 of the shaft 56 is of smaller diameter so as to match the shoulder 54.

The top and bottom parts 14 and 12 of the bit also has respective ramp-forming extensions 30 and 32 and ramp-forming recesses 34 and 36 as shown in FIGS. 1A to 1C.

There follows a description of how this embodiment of the bore bit operates, given with reference to FIGS. 4A to 4C. When the bit is suspended from the end of the cable 20, its bottom part is connected to the top part 14 by the chains 42. The shaft 56 is engaged in the axial bores 50 and 52 and it is supported by the shoulder 54 (FIG. 4A).

When the bottom part 12 comes into contact with the bottom of the borehole 60, the ramps impart rotary movement to the top part 14. In addition, the mud 62 present in the borehole acts on the bottom end of the shaft 56, thereby lifting it (FIG. 4B).

When the top part 14 comes into contact with the bottom part 12, the rotary movement of the top part imparts rotary movement to the bottom part 12, as explained above. Simultaneously, the top part 14 of the bit causes the shaft 56 to move downwards, thereby expelling the mud that has penetrated into the bottom part of the axial bore 52, in the manner of a piston. This forces the mud to circulate between the tips of the bit, thereby "cleaning" the tools 38 of the bit.

Preferably, the number of extensions 30, 32 and thus the number of recesses 34, 36 is restricted to two. This makes it possible to achieve an angle of relative rotation between the two parts of the bit that is sufficient to impart enough rotation to the bottom part of the bit. This also makes it possible to have vertical surfaces 23 and 25 and thus to ensure that torque is transmitted effectively.

What is claimed is:

1. A bore bit comprising:

a bottom part having an active bottom face and a top face that is substantially parallel to the active face;

a top part having a top face provided with members for fastening to support cables and a bottom face facing the top face of the bottom part; and means for limiting the extent to which the two parts can move apart, while allowing them to move towards each other;

said bore bit further comprising:

a cylindrical axial bore passing through said two parts;

a cylindrical guide penetrating freely in said axial bore; and at least one ramp-forming recess opening out into one of the facing faces and at least one ramp-forming extension projecting from the other of the facing faces to co-operate with said ramp-forming recess in such a manner that movement of the top part towards the bottom part is converted into rotary movement of said top part about the common axis of the axial bore and the cylindrical guide, with the stopping of rotation of the top part imparting rotary movement to the bottom part.

2. A bit according to claim 1, wherein said ramp-forming recess forms a part of the bottom part of the bit and the cylindrical guide and the ramp-forming extension form parts of the top part of the bit.

3. A bit according to claim 2, wherein the bottom and top parts are cylindrical, having axes corresponding respectively to the axis of the cylindrical guide and to the axis of the axial bore, and wherein:

said ramp-forming extension is defined by a portion of a cylindrical helix and by a portion of a plane containing the axis of said axial bore; and said ramp-forming recess is defined by a portion of a helix identical to the helix of the ramp-forming extension, and by a portion of a vertical plane containing the axis of said axial bore, co-operation between the vertical planes imparting rotary movement to the bottom part at the end of the rotary movement of the top part.

4. A bit according to claim 2, having two ramp-forming recesses disposed symmetrically about the common axis of the cylindrical bore and of the cylindrical guide, and two ramp-forming extensions disposed symmetrically about the common axis of the cylindrical bore and of the cylindrical guide.

5. A bit according to claim 2, wherein said axial bore formed in said bottom part opens out into the bottom face of said bottom part.

6. A bit according to claim 1, wherein said cylindrical guide is constituted by a part which is distinct from the top and bottom parts, said guide being in the form of a cylindrical shaft engaged in the cylindrical axial bore formed in said top and bottom parts of the bit.

7. A bit according to claim 1, wherein the means for limiting the extent to which the bottom and top parts can move apart comprises at least one chain having its ends connected respectively to the outside wall of said top part and to the outside wall of said bottom part.

8. A bit according to claim 7, having two chains disposed symmetrically about the axis common to the cylindrical bore and to the cylindrical guide.

9. A bit according to claim 8, wherein, when the chain(s) is/are under tension, corresponding to the bottom and top parts being at their maximum distance apart, the end(s) of the ramp-forming extension(s) penetrate(s) into the ramp-forming recess(es).

* * * * *